US011761239B2

(12) United States Patent
Kuenzi et al.

(10) Patent No.: US 11,761,239 B2
(45) Date of Patent: Sep. 19, 2023

(54) BUILDING ACCESS SYSTEM WITH PROGRAMMING DOOR LOCKS

(71) Applicant: Carrier Corporation, Palm Beach Gardens, FL (US)

(72) Inventors: Adam Kuenzi, Silverton, OR (US); Steve Switzer, Atlanta, GA (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/252,037

(22) PCT Filed: Sep. 10, 2020

(86) PCT No.: PCT/US2020/050033
§ 371 (c)(1),
(2) Date: Dec. 14, 2020

(87) PCT Pub. No.: WO2021/050616
PCT Pub. Date: Mar. 18, 2021

(65) Prior Publication Data

US 2022/0307289 A1 Sep. 29, 2022

Related U.S. Application Data

(60) Provisional application No. 62/900,079, filed on Sep. 13, 2019.

(51) Int. Cl.
*E05B 35/00* (2006.01)
*G07C 9/00* (2020.01)

(52) U.S. Cl.
CPC ..... *E05B 35/007* (2013.01); *G07C 9/00817* (2013.01); *G07C 9/00904* (2013.01)

(58) Field of Classification Search
CPC ..... E05B 35/007; G07C 9/00817; G07C 9/00904; G07C 9/00174; G07C 9/00571; G07C 9/00; G05B 19/0423; G05B 2219/24215
USPC ..... 340/5.25, 5.61, 5.24
See application file for complete search history.

(56) References Cited

U.S. PATENT DOCUMENTS

| | | | | |
|---|---|---|---|---|
| 3,906,447 | A | 9/1975 | Crafton | |
| 4,213,118 | A | 7/1980 | Genest et al. | |
| 4,717,816 | A | 1/1988 | Raymond et al. | |
| 4,770,012 | A | 9/1988 | Johansson et al. | |
| 4,811,012 | A | 3/1989 | Rollins | |
| 4,845,490 | A | 7/1989 | Ward et al. | |
| 5,055,658 | A * | 10/1991 | Cockburn | G07C 9/00563 235/382 |
| 5,170,431 | A | 12/1992 | Dawson et al. | |
| 5,260,551 | A | 11/1993 | Wiik et al. | |
| 5,416,471 | A | 5/1995 | Trecharne et al. | |
| 5,508,691 | A | 4/1996 | Castleman et al. | |
| 5,986,564 | A | 11/1999 | Fraser | |

(Continued)

FOREIGN PATENT DOCUMENTS

| | | |
|---|---|---|
| FR | 2770562 A1 | 5/1999 |
| WO | 0142598 A1 | 6/2001 |

OTHER PUBLICATIONS

International Search Report for International Application No. PCT/US2020/050033; Date of Completion: Nov. 12, 2020; dated Nov. 20, 2020; 5 Pages.

(Continued)

*Primary Examiner* — Nam V Nguyen
(74) *Attorney, Agent, or Firm* — CANTOR COLBURN LLP

(57) ABSTRACT

Disclosed is an entry system for a building having: a first door lock that includes a controller; wherein the first door lock is configured for encoding access rights to a first client keycard responsive to a first engagement with a master keycard.

14 Claims, 4 Drawing Sheets

(56) References Cited

U.S. PATENT DOCUMENTS

| | | | | |
|---|---|---|---|---|
| 6,876,293 | B2 | 4/2005 | Frolov et al. | |
| 6,897,767 | B2 | 5/2005 | Kim | |
| 7,737,846 | B2 * | 6/2010 | Belden, Jr. | G08B 13/1445 340/815.45 |
| 8,274,365 | B2 | 9/2012 | Piccirillo et al. | |
| 8,620,268 | B2 | 12/2013 | Metivier | |
| 8,979,446 | B2 * | 3/2015 | Freeman | B23C 3/35 700/161 |
| 9,841,743 | B2 * | 12/2017 | Davis | G05B 19/02 |
| 10,114,938 | B2 * | 10/2018 | Marchiori | G07C 9/00174 |
| 10,390,079 | B2 * | 8/2019 | Miller | H04N 21/43615 |
| 10,706,649 | B2 * | 7/2020 | Kuenzi | G07C 9/00904 |
| 11,120,657 | B2 * | 9/2021 | Ma | G07C 9/00904 |
| 2006/0037372 | A1 | 2/2006 | Jones | |
| 2007/0200661 | A1 * | 8/2007 | Blum | G07C 9/20 340/5.24 |
| 2008/0061927 | A1 | 3/2008 | Manton | |
| 2011/0074543 | A1 | 3/2011 | Kaczmarz et al. | |
| 2019/0035188 | A1 | 1/2019 | Kuenzi et al. | |
| 2019/0130674 | A1 | 5/2019 | Baumgarte et al. | |

OTHER PUBLICATIONS

Written Opinion of the International Searching Authority for International Application No. PCT/US2020/050033; International Filing Date: Sep. 10, 2020; dated Nov. 20, 2020; 8 Pages.

* cited by examiner

BUILDING ACCESS SYSTEM WITH PROGRAMMING DOOR LOCKS

CROSS REFERENCE TO RELATED APPLICATIONS

This application is a Non-Provisional Application of PCT/US2020/050033 filed Sep. 10, 2020, which claims the benefit of U.S. Application No. 62/900,079 filed Sep. 13, 2019, the disclosure of which is incorporated herein by reference in its entirety.

BACKGROUND

The disclosed embodiments related to a building management system and more specifically to a building management system with programming door locks.

Construction cards for a hotel in a construction phase may be encoded at a factory. These cards may be identical and shipped all over the globe and provide holders of the cards unrestricted access to a construction site so long as the cards remain active. In an active hotel, when the front desk system goes down, a hotel may be unable to encode cards. Thus, active hotels may need to pre-encode spare cards and keep them in the hotel safe.

BRIEF SUMMARY

Disclosed is an entry system for a building comprising: a first door lock that includes a controller; wherein the first door lock is configured for encoding access rights to a first client keycard responsive to a first engagement with a master keycard.

In addition to one or more of the above disclosed aspects or as an alternate engaging the master keycard includes the first door lock monitoring the occurrence of a predetermined combination of actions proximate in time to the first engagement with the master keycard.

In addition to one or more of the above disclosed aspects or as an alternate monitoring the occurrence of the predetermined combination of actions includes the first door lock monitoring the occurrence of one or more additional engagements with the master keycard and receiving manual actuation of a first door handle of the first door lock.

In addition to one or more of the above disclosed aspects or as an alternate the first door lock is configured for granting the access rights to the first client keycard for a predetermined period of time relative to a time of the first door lock.

In addition to one or more of the above disclosed aspects or as an alternate the first door lock is configured for granting access rights at a plurality of door locks to the first client keycard, wherein the plurality of door locks includes the first door lock.

In addition to one or more of the above disclosed aspects or as an alternate the first door lock is configured for revoking any active access rights for any other client keycard if and for as long as communications over a network with a network hub are unavailable.

In addition to one or more of the above disclosed aspects or as an alternate responsive to communications over the network with the network hub subsequently becoming available, the first door lock is configured for revoking access rights to the first client keycard.

In addition to one or more of the above disclosed aspects or as an alternate the first door lock is configured for granting access rights at a plurality of door locks to a plurality of client keycards, wherein the plurality of door locks includes the first door lock and the plurality of client keycards includes the first client keycard.

In addition to one or more of the above disclosed aspects or as an alternate the first door lock is configured for granting the access rights based on a system parameter encoded in the master keycard and the first door lock, and a sequence number the first door lock encodes onto the plurality of client keycards.

In addition to one or more of the above disclosed aspects or as an alternate the first door lock is configured for revoking any active access rights for any other client key.

Further disclosed is a method of controlling an entry system for a building comprising a first door lock encoding access rights to a first client keycard responsive to a first engagement with a master keycard.

In addition to one or more of the above disclosed aspects or as an alternate engaging the master keycard includes the first door lock monitoring the occurrence of a predetermined combination of actions proximate in time to the first engagement with the master keycard.

In addition to one or more of the above disclosed aspects or as an alternate monitoring the occurrence of the predetermined combination of actions includes monitoring the occurrence of one or more additional engagements with the master keycard and receiving manual actuation of a first door handle of the first door lock.

In addition to one or more of the above disclosed aspects or as an alternate the method includes the first door lock granting the access rights to the first client keycard for a predetermined period of time.

In addition to one or more of the above disclosed aspects or as an alternate the method includes the first door lock granting access rights at a plurality of door locks to the first client keycard, wherein the plurality of door locks includes the first door lock.

In addition to one or more of the above disclosed aspects or as an alternate the method includes the first door lock revoking any active access rights for any other client key while communications over a network with a network hub are unavailable.

In addition to one or more of the above disclosed aspects or as an alternate the method includes the first door look revoking access rights to the first client key card responsive to communications over the network with the network hub subsequently becoming available.

In addition to one or more of the above disclosed aspects or as an alternate the method includes the first door lock granting access rights at a plurality of door locks to a plurality of client keycards, wherein the plurality of door locks includes the first door lock and the plurality of client keycards includes the first client keycard.

In addition to one or more of the above disclosed aspects or as an alternate the method includes the first door lock granting the access based on a system parameter encoded in the master keycard and the first door lock, and a sequence number the first door lock encodes onto the plurality of client keycards.

In addition to one or more of the above disclosed aspects or as an alternate the method includes first door lock revoking any active access rights for any other client keycard.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
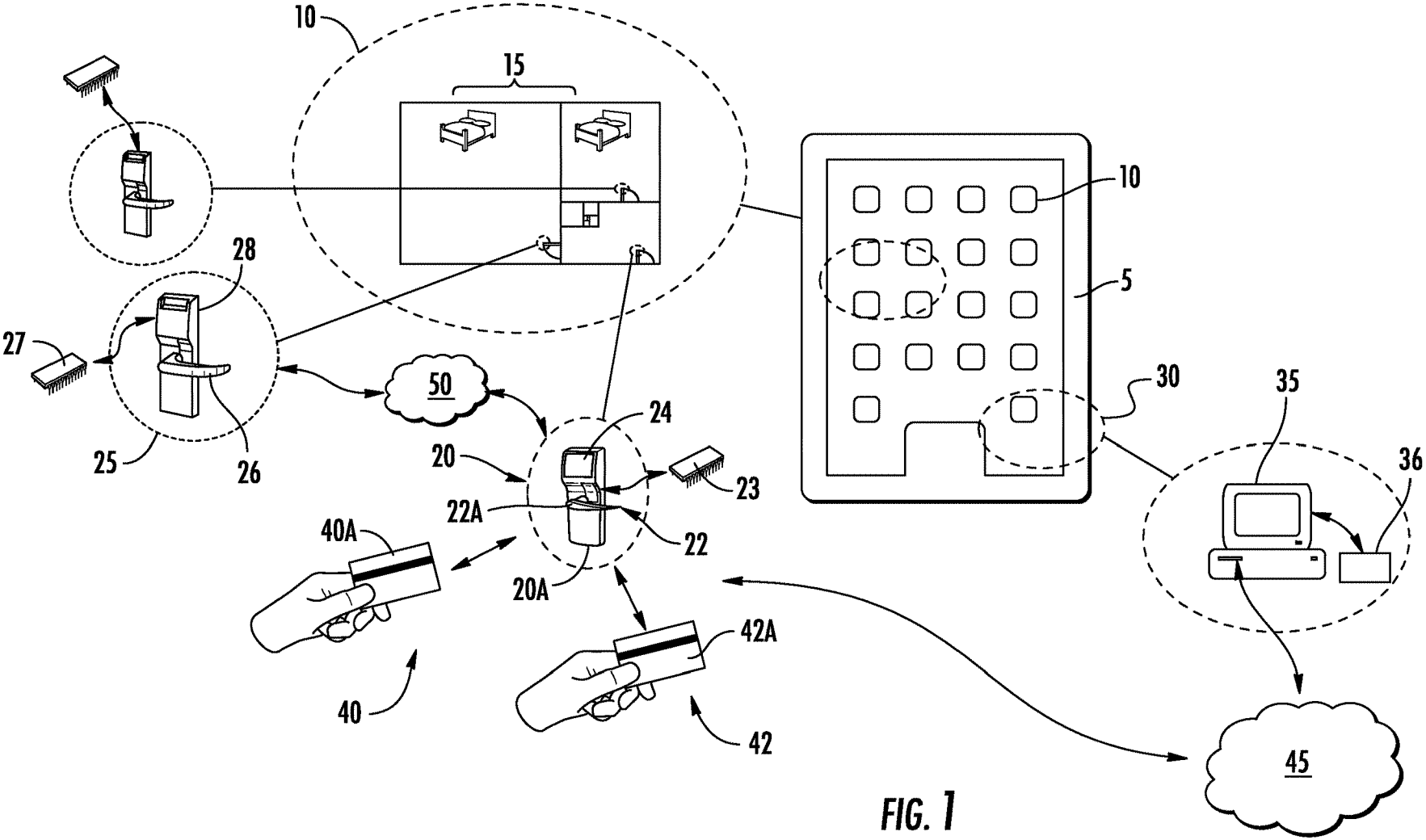
FIG. 1 is a schematic representation of a building with a building access system which includes features of at least one of the disclosed embodiments.

Turning to FIG. 1 a building 5, which may be a hotel, may include a plurality of suites 10 with a plurality of rooms 15 therein. Each of the plurality of suites 10 may have one of a plurality of suite locks 20, each with one of a plurality of suite-lock handles 22, suite-lock controllers 23 and suite-lock keycard readers 24. Each of the plurality of rooms 15 may have one of a plurality of room locks 25, each with one of a plurality of room-lock handles 26, room-lock controllers 27 and room-lock keycard readers 28. A main lobby 30 may include a main hub 35, otherwise referred to as a network hub or front desk, for the hotel. The main hub 35 may be utilized to program access rights to management keycards, otherwise referred to as master keycards 40, and guest keycards, otherwise referred to as client keycards 42. For example the access rights may be used to access one of the suites 10 and a selective ones of the rooms 15 within the one of the suites 10. The main hub 35 may communicate with the plurality of suite locks 20 over a network 45. The suite locks 20 may communicate with the plurality of room locks 25 over a same or different network 50. Each network may be wired or wireless executing any one of known protocols.

There may be occasions where spare version of client keycards 42 are needed to enter a suite. This may occur if a guest loses their client keycards 42. The spare version of the client keycards 42 may be the same as the client keycards 42 or may have fewer access rights as indicated herein. The spare version of client keycards 42 may be needed when a system power outage occurs so that the main hub 35 cannot encode client keycards 42. The main hub 35 may be software on a computer with an attached encoder device 36. The encoder device 36 may be a type associated with encoding keycards. For example the encoder may be an RFID encoder. Typical RFID cards include for example MIFARE, of NXP Semiconductors N.V., and which is based on the ISO/IEC 14443 Type A 13.56 MHz contactless smart card standard.

In addition, during a power outage, the main hub 35 and suite locks 20 may be unable to communicate with one another. During such time, as disclosed herein, upon being provided with one of the master keycards 40, the suite locks 20 may be utilized for the programming of the spare version of the client keycards 42. To enter a programming mode, the master keycards 40 may be presented to the suite lock 20 with a combination of actions. The combination of actions may include engaging a magnetic strip (which may alternatively be RFID) of one of the master keycards 40 against one of the suite-lock keycard readers 24 a predetermined number of times and/or accompanied by engaging a respective one of the suite-lock handles 22. It is to be appreciated that an interior handle or exterior handle may be utilized rather than a suite lock handle.

Additionally the combination of actions may include a privacy knob action as well. For example, the knob action may include a pre-defined sequence that is not 'normal use' but is detectable by the lock as a specific sequence that triggers the programming mode. The knob action may include rotating the door handle a few times. The knob action may also be engaged by rotating the privacy knob (on the inside of the door). In certain utilizations, rotating the privacy knob engages a deadbolt. In certain utilizations the knob functions as an electronic privacy switch that the door lock senses. In such utilizations the door look 20 will prevent client keycards 42 from opening the door lock unless the privacy switch is set to disabled, but may allow the master card 40 to open the door if it has a privacy-override permission on the card. An example set of sequences for the knob action include: unlocking the door and opening the door; while door is open, rotating handle twice; then rotating the privacy knob twice; etc.

Figure 2:
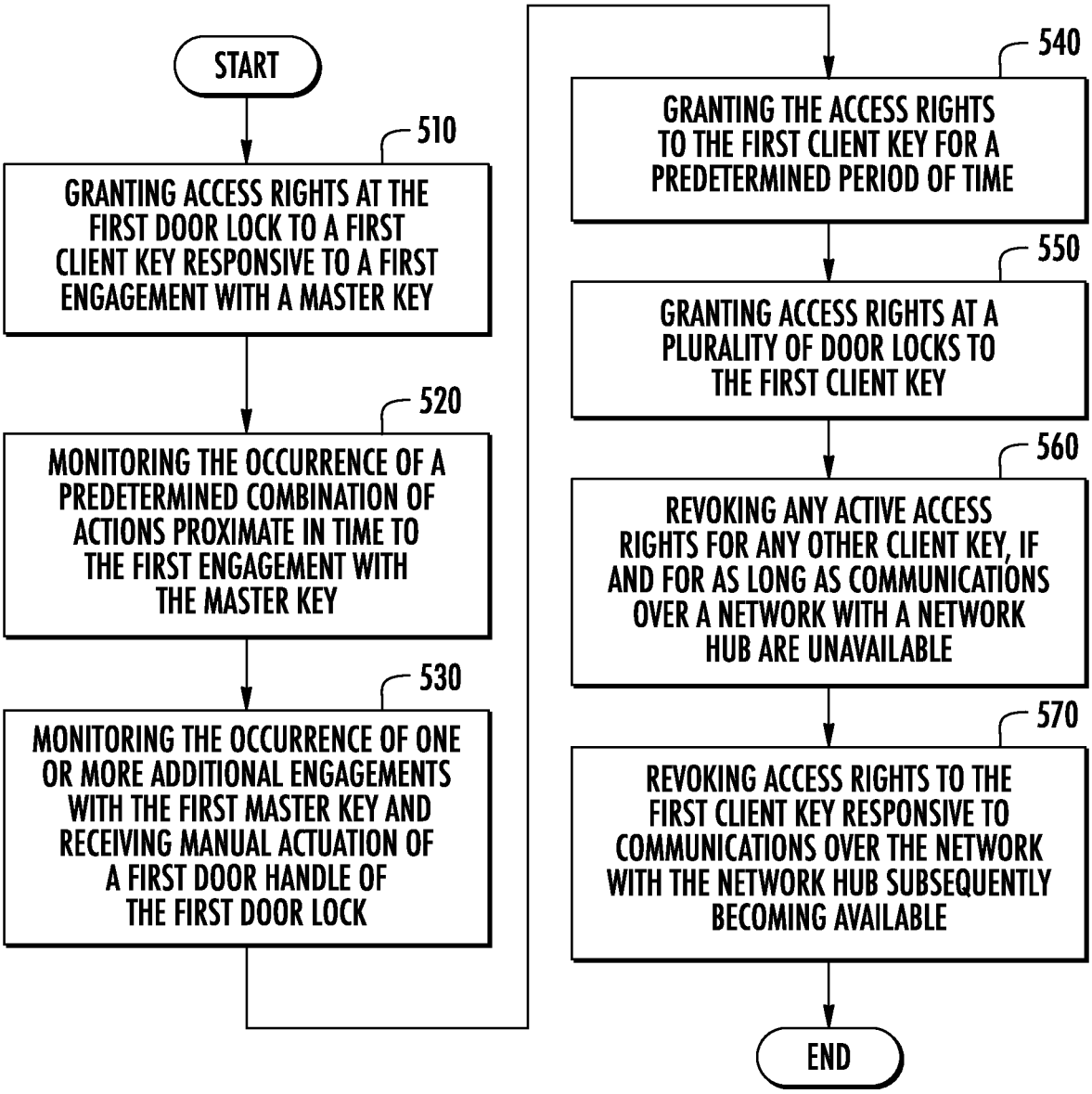
FIG. 2 is a flowchart showing a method of obtaining access to one or more suites in a building that includes the system of FIG. 1.

Turning to FIG. 2, a flowchart shows a method of controlling an entry system for the building 5 according to an embodiment. With continued reference to FIGS. 1 and 2, as shown in block 510 the method includes a first door lock 20A, e.g., one of the suite locks 20, granting access rights to a first client keycard 42A, that is, a spare version of the client keycards 42. This is executed by the first door lock 20A entering a programming mode to program the first client keycard 42A. For example the first client keycard may include a magnetic strip that may be programed by the first door lock 20A and initially may be blank or have no customized data written on the card. The first door lock 20A executes steps under block 510 responsive to a first engagement with a master keycard 40A.

As shown in block 520, the step of engaging the master keycard 40A includes the first door lock 20A monitoring the occurrence of a predetermined combination of actions proximate in time to the first engagement with the master keycard 40A. As shown in block 530, such monitoring includes the first door lock 20A monitoring the occurrence of one or more additional engagements with the master keycard 40A and receiving manual actuation of a first door handle 22A of the first door lock 20A.

As shown in block 540 the method includes the first door lock 20A granting the access rights to the first client keycard 42A for a predetermined period of time relative to the current time in the lock. For example, the spare version of the guest keycard may provide for a two-day access to the suite.

As shown in block 550 the method includes the first door lock 20A granting access rights at a plurality of door locks 160 to the first client keycard 42A. For example, a plurality of room locks 25 may be in the suite in addition to the first door lock 20A. The first client keycard 24A may be granted access rights to all or some of the plurality of room locks 25 in addition to the first door lock 20A. Steps performed under blocks 540 and 550 result in a client keycard 42A being presented to the lock in a blank state and the lock encoding the granted access rights onto the client keycard 42A so that it ends in an encoded state.

As shown in block 560 the method includes the first door lock 20A revoking any active access rights that any other client keycard may have to the first door lock 20A. The steps performed under block 560 occur if communications over the network 45 with the main hub 35 are unavailable when programming the spare version of the guest keycard. Further, as illustrated in block 570 the method may include the first door lock 20A revoking access rights to the first client keycard 42A once the network hub becomes available. For example, the method may include revoking the client keycard 42A once another client keycard 42 is utilized that was encoded by the main hub after coming back online, etc.

Figure 3:
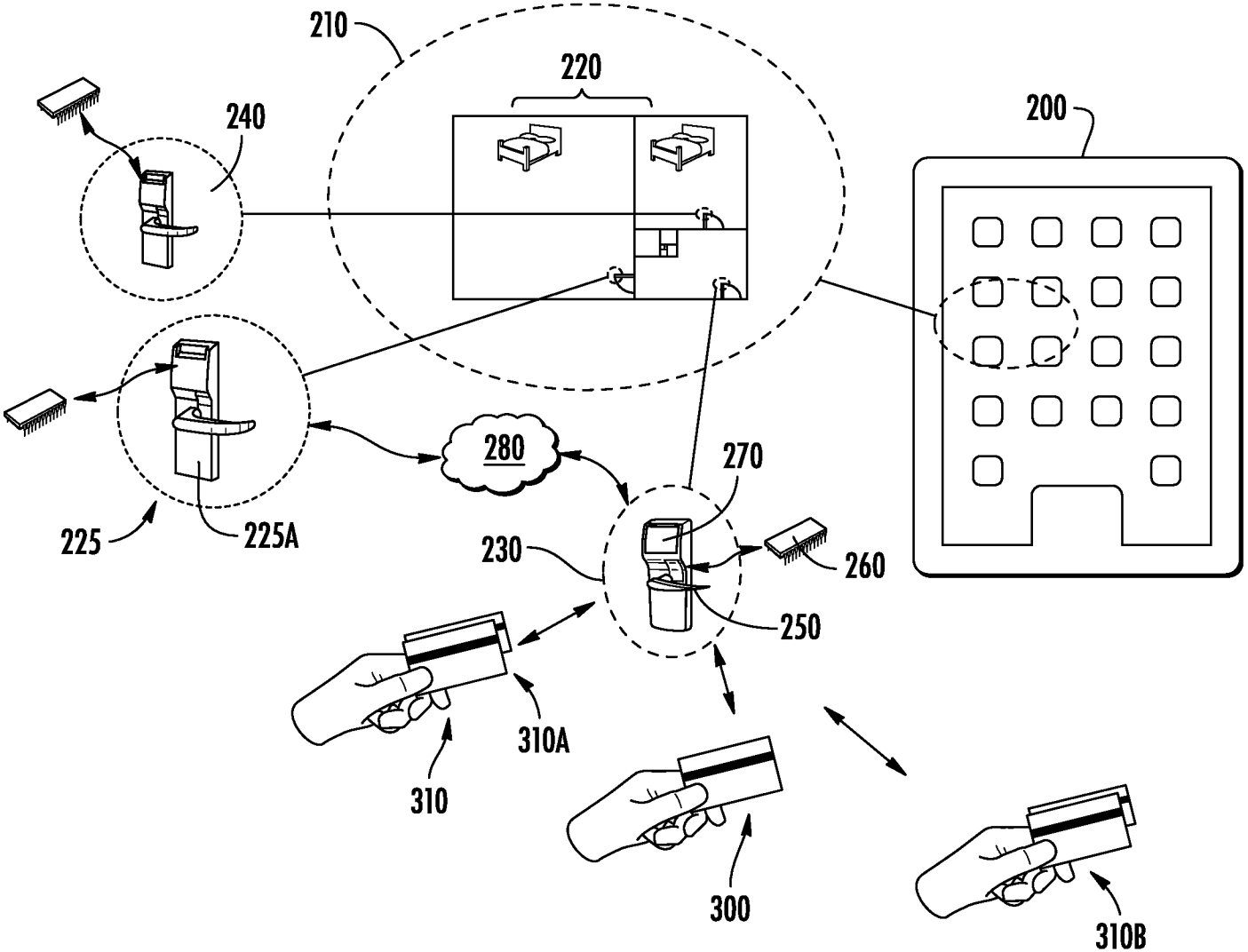
FIG. 3 is a schematic representation of another building with a building access system which includes features of at least one of the disclosed embodiments.

Turning to FIG. 3 a construction site for a building 200 which may be for a hotel may include a plurality of suites 210, each with a plurality of rooms 220. At a certain stage of construction, each of the plurality of suites 210 and rooms 220 may have one of a plurality of door locks 225, including suite locks 230 and room locks 240. The door locks 225 may each be mounted to one of a plurality of mounted doors. Each of the door locks 225 may have one of a plurality of handles 250, controllers 260, and keycard readers 270.

The door locks 225 may communicate with one another over a wired or wireless network 280 executing any one of known protocols. Once the door locks 225 are installed, it may be desirable to control a flow of continued construction, however, the building 200 may not have a main hub 35 that can communicate with the plurality of suite locks 20 over a yet to exist network 45 (referencing FIG. 1). For example, it may be desirable to allow carpet installers to perform their work and to prevent prior contractors (i.e. electricians or painters) from entering. That is, there may be be a desired sequence of action for the contractor teams and access is controlled in a flow of continued construction. As disclosed herein the door locks 225 may be utilized for the control of flow of continued construction. In addition, the door locks 225 may be utilized to control the flow between hotels so that contractors may not use their cards 310 to go to another hotel.

The flow control may be obtained by utilizing a master keycard 300. A first plurality of client keycards 310 is distributed to a first contractor team who uses them for a first period of time to accomplish a first task. A second plurality of client keycards 310 is distributed to a second contractor team who uses them for a second period of time to accomplish a second task that is subsequent to the first task.

The first set of client keycards 310A is encoded by action of the door lock 225 upon being presented with the master keycard 300. The second set of client keycards 310B is encoded by action of the door lock 225 upon being presented, once again, with the master keycard 300. The master keycard 300 may identify the proper sequence for the contractor teams. In practice the first time the master keycard 300 is used, the door locks 225 would start with a default sequence number. When the method 510 is used to encode a first set of a plurality of client keycards 310, this first set would have a higher sequence number. Later when the method is used again, the second set would have an even higher sequence number.

When the master keycard 300 is used along with a combination of actions (block 520), the door lock 225 enters a mode for encoding a client keycard 310. This is done by the door lock 225 having the ability to read from and write to (program) a client keycard. When the door lock 225 goes into programming mode it may blink one or more lights (utilizing on-board light emitting diodes) a predetermined sequence or sound (utilizing an on-board speaker) audible tone to indicate that the programming mode is engaged. The door lock 225 may remain in the programming mode for a predetermined time and then return to non-programming (e.g., normal) operation. While in programming-mode the door lock 225 may encode multiple client keycards 310 if presented with such client keycards 310, e.g., which may be blank upon presentation to the door lock.

For example, if in a construction phase, the next two contractor teams may be wall plasters and wall painters, in that order. Thus, the plaster team will be needed at a site before the painter team. The plaster team would receive the first plurality of the client keycards 310A. The painter team would receive the second plurality of the client keycards 310B. The encoded sequence in the master keycard 300 would be such that the plaster team has a lower number encoded in the second plurality of client keycards 310A as compared with the painter team.

In use, the general contractor would arrive to meet the plaster team and open one of the door locks 225 with the master keycard 300. The opened one of the door locks 225 enters a programming mode and can program the client keycards at this time with the proper sequence number to provide immediate access to the plaster team. All client keycards encoded with a previous sequence number, if any, are now locked out. After the plaster team is finished, the process is repeated. The general contractor would arrive to meet the painter team and open one of the door locks 225 with the master keycard 300. The opened one of the door locks 225 enters a programming mode and can program additional client keycards at this time with the proper next sequence number to provide immediate access to the painter team. All client keycards encoded with a previous sequence number, i.e., for the plaster team, are now locked out. It is to be appreciated that the master card 300 always has access. In addition, rather than sending the different teams client keycards that are not yet programmed, the general contractor may arrive with both the master keycard and the requisite number of client keycards for the given team.

In other words, in the disclosed embodiments there is only one master keycard 300. This master keycard 300 is used to trigger the door lock to program the first plurality of client keycards 310A and program them from blank to the next sequence number. Later, if the master card 300 is used again, another plurality of client keycards 310B can be encoded with the next sequence number. The master keycard 300 may always open the lock irrespective of the sequence number. The child keycards are controlled by the sequence number and they can be programmed in batches.

That is, a master keycard 300 is identified separately from the client keycards 310. The master keycard 300 is allowed access based on a matching system parameter—i.e. all the locks 225 in a hotel would have the same matching parameter. When the special sequence is done to put a factory lock 225 into programming mode for the first time to make some client keycards 310, the factory lock 225 would read the system parameter from the master keycard 300 and store this in the lock 225. Hereafter this lock 225 will only respond to this master keycard 300 and to any client keycards 310 that have this same system parameter. Otherwise the lock will not open for other master keycard 300 that have different system parameters. Once in a programming mode, the very first time, the lock 225 will assume a default sequence number (i.e. 1) and will make client keycards 310 from blank cards. These client keycards 310 will have the system parameter and the sequence of 1. Later, when the special sequence is repeated with the master keycard 300, the lock 225 will advance the sequence number (i.e. to 2) and will make a new set of client keycards 310 from blank cards. This second set will have the same system parameter and the sequence of 2. All along, the master keycard 300 has the system parameter, though not a list of sequence numbers. When the lock has a sequence of 2, it will essentially revoke or prevent access to client keycards 310 that have the sequence of 1. As client keycards 310 that have the sequence of 2 are used on locks that are still at sequence of 1, these locks will advance their sequence numbers to a 2 (since it is greater than 1) and in essence this will revoke all of the client keycards with a lower sequence number on all of the locks once they have been opened.

When a master keycard 300 is used, the lock 225 will ignore the sequence number and just compare with the system parameter. That is, the comparison is done by the lock 225 in order to determine that the master keycard 300 is authorized to open the lock 225. When in the factory mode, the lock 225 would accept any master keycard 300 and open because there is no established system parameter. But, once the system parameter is established, then only this master keycard 300 can open the lock 225. And, once this master keycard 300 is used to put the lock into programming mode, then client keycards 310 can be made based on the sequence numbers and these keycards 310 can be obsoleted as the sequence number advances, etc.

As indicated a door lock 225 may utilize method 510 to enter a programming mode and program each of the client keycards 310 to access each of the door locks 225. For example a first door lock 225A may engage the master keycard 300, determine that the access method is performed, and enter a programming mode. While in the programming mode, each of the client keycards 310 may be successively programmed by the first door lock 225A. At this same time, all previously granted access rights for any preceding contacting team is revoked.

Figure 4:
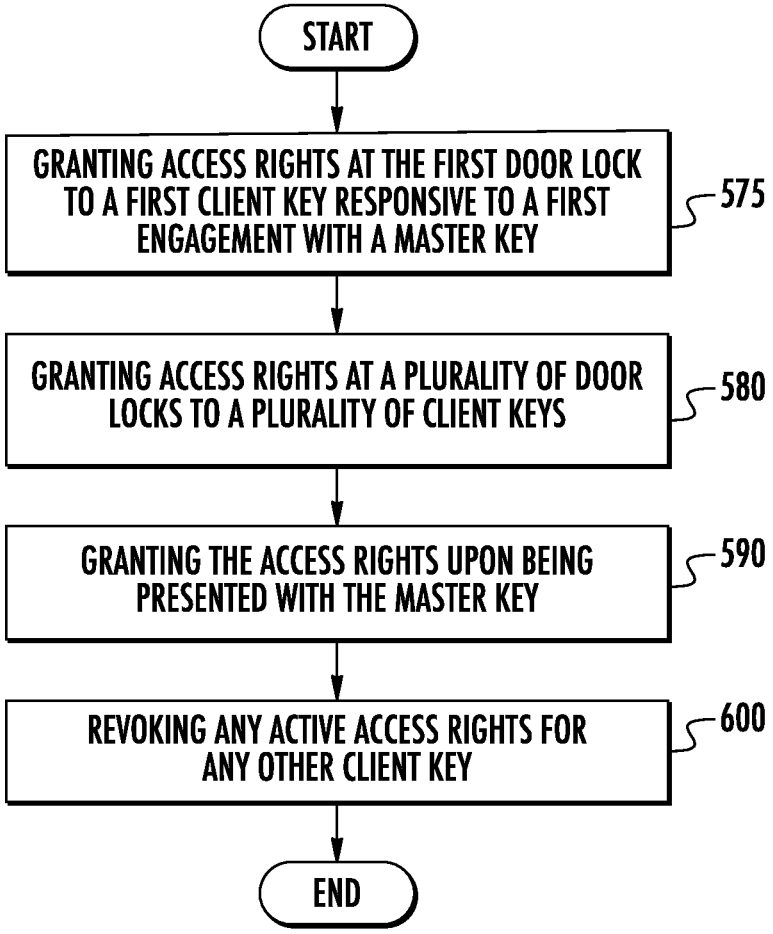
FIG. 4 is a flowchart showing a method of obtaining access to one or more suites in a building that includes the system of FIG. 3.

Turning to FIG. 4, a flowchart shows a method of controlling an entry system for the building 200 according to an embodiment. With continued reference to FIGS. 3 and 4, and as illustrated in block 575 the method includes the first door lock 225A granting access rights to a first client keycard 310A by encoding the keycard 310A. The first door lock 225A executes steps under block 575 responsive to a first engagement with the master keycard 300 provided in-sequence to any other contracting team and with the method 510.

As shown in block 580 the method includes the first door lock 225A (FIG. 1) granting access rights at a plurality of door locks 225 to a plurality of the client keycards 310. The plurality of door locks 225 includes the first door lock 225A. The plurality of client keycards 310 includes the first client keycard 310A. As indicated and shown in block 590 the method includes the first door lock 225A granting the access rights upon being presented with the master keycard 300. As illustrated in block 600 the method includes first door lock 20A revokes any active access rights for any other client keycard. This action locks out all previous contractor teams.

As described above, embodiments can be in the form of processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. An entry system for a building that includes a plurality of suites, each having a suite lock and a plurality of rooms, each having a room lock, the system comprising:

a first door lock that is a suite lock for one of the suites, that includes a controller;

wherein the first door lock is configured for encoding access rights to a first client keycard, that is a guest keycard, responsive to a first engagement with a master keycard, wherein engaging the master keycard includes the first door lock monitoring the occurrence of a predetermined combination of actions proximate in time to the first engagement with the master keycard;

wherein monitoring the occurrence of the predetermined combination of actions includes the first door lock monitoring the occurrence of one or more additional engagements with the master keycard and receiving manual actuation of a first door handle of the first door lock;

wherein the first door lock is configured for granting access rights at a plurality of door locks to the first client keycard, wherein the plurality of door locks includes the first door lock and selective ones of the room locks within the suite, the selective ones of the room locks being less than all of the room locks within the suite.

2. The system of claim 1, wherein the first door lock is configured for granting the access rights to the first client keycard for a predetermined period of time relative to a time of the first door lock.

3. The system of claim 1, wherein the first door lock is configured for revoking any active access rights for any other client keycard if and for as long as communications over a network with a network hub are unavailable.

4. The system of claim 3, wherein responsive to communications over the network with the network hub subsequently becoming available, the first door lock is configured for revoking access rights to the first client keycard.

5. The system of claim 1, wherein the first door lock is configured for granting access rights at a plurality of door locks to a plurality of client keycards, wherein the plurality of door locks includes the first door lock and the plurality of client keycards includes the first client keycard.

6. The system of claim 5, wherein the first door lock is configured for granting the access rights based on a system parameter encoded in the master keycard and the first door lock, and a sequence number the first door lock encodes onto the plurality of client keycards.

7. The system of claim 5, wherein the first door lock is configured for revoking any active access rights for any other client key.

8. A method of controlling an entry system for a building that includes a plurality of suites, each having a suite lock and a plurality of rooms, each having a room lock, the building comprising:

a first door lock that is a suite lock for one of the suites, that includes a controller, the first door lock encoding access rights to a first client keycard, that is a guest keycard, responsive to a first engagement with a master keycard, wherein engaging the master keycard includes the first door lock monitoring the occurrence of a predetermined combination of actions proximate in time to the first engagement with the master keycard;

wherein monitoring the occurrence of the predetermined combination of actions includes monitoring the occurrence of one or more additional engagements with the master keycard and receiving manual actuation of a first door handle of the first door lock;

wherein the method includes the first door lock granting access rights at a plurality of door locks to the first client keycard, wherein the plurality of door locks includes the first door lock and selective ones of the room locks within the suite, the selective ones of the room locks being less than all of the room locks within the suite.

9. The method of claim 8, wherein the method includes the first door lock granting the access rights to the first client keycard for a predetermined period of time.

10. The method of claim 8, wherein the method includes the first door lock revoking any active access rights for any other client key while communications over a network with a network hub are unavailable.

11. The method of claim 10, wherein the method includes the first door look revoking access rights to the first client keycard responsive to communications over the network with the network hub subsequently becoming available.

12. The method of claim 8, wherein the method includes the first door lock granting access rights at a plurality of door locks to a plurality of client keycards, wherein the plurality of door locks includes the first door lock and the plurality of client keycards includes the first client keycard.

13. The method of claim 12, wherein the method includes the first door lock granting the access rights based on a system parameter encoded in the master keycard and the first door lock, and a sequence number the first door lock encodes onto the plurality of client keycards.

14. The method of claim 12, wherein the method includes first door lock revoking any active access rights for any other client keycard.

* * * * *